US011148928B1

(12) United States Patent
Huang

(10) Patent No.: US 11,148,928 B1
(45) Date of Patent: Oct. 19, 2021

(54) HOT WATER DISPENSER

(71) Applicants: DAWNWAY ENTERPRISE CO., LTD., Taichung (TW); Miaoyun Huang, Visalia, CA (US)

(72) Inventor: Wen-Shun Huang, Taichung (TW)

(73) Assignees: DAWNWAY ENTERPRISE CO., LTD., Taichung (TW); Miaoyung Huang, Visalia, CA (US)

( * ) Notice: Subject to any disclaimer, the term of this patent is extended or adjusted under 35 U.S.C. 154(b) by 0 days.

(21) Appl. No.: 17/004,984

(22) Filed: Aug. 27, 2020

(51) Int. Cl.

| | |
|---|---|
| ***B67D 1/12*** | (2006.01) |
| ***B67D 1/00*** | (2006.01) |
| ***E03C 1/04*** | (2006.01) |
| ***B67D 1/08*** | (2006.01) |

(52) U.S. Cl.
CPC ..... *B67D 1/12* (2013.01); *B67D 1/0014* (2013.01); *B67D 1/0801* (2013.01); *B67D 1/0895* (2013.01); *E03C 1/0411* (2013.01)

(58) Field of Classification Search
CPC ..... B67D 1/12; B67D 1/0014; B67D 1/0801; B67D 1/0895; E03C 1/0411
See application file for complete search history.

(56) References Cited

U.S. PATENT DOCUMENTS

| | | | | |
|---|---|---|---|---|
| 3,104,306 A * | 9/1963 | Markley, Jr. | A47J 31/54 392/451 | |
| 5,343,552 A * | 8/1994 | Peteri | A47J 31/54 392/451 | |
| 6,847,782 B1 | 1/2005 | Kovacs | | |
| 2007/0044736 A1* | 3/2007 | DeSantis | F24H 1/188 122/19.1 | |
| 2018/0135279 A1* | 5/2018 | Liu | E03C 1/044 | |
| 2020/0270850 A1* | 8/2020 | Kop | F24H 9/2021 | |

FOREIGN PATENT DOCUMENTS

| | | |
|---|---|---|
| CN | 206342341 U | 7/2017 |
| CN | 206434197 U | 8/2017 |
| CN | 206944452 U | 1/2018 |
| CN | 207613641 U | 7/2018 |
| TW | I384191 B | 2/2013 |
| TW | M499534 U | 4/2015 |
| TW | M536736 U | 2/2017 |
| TW | I632334 B | 8/2018 |
| TW | I632334 B | 8/2018 |

* cited by examiner

*Primary Examiner* — Jeremy Carroll
(74) *Attorney, Agent, or Firm* — Muncy, Geissler Olds & Lowe, P.C.

(57) ABSTRACT

The present invention discloses a hot water dispenser comprising a water tank, an expansion chamber, and a Venturi module. The expansion chamber comprises a top shell, a bottom shell connected to the top shell, and a flexible bladder. Wherein, the water tank is connected to a dedicated faucet, the Venturi module is connected to a water source through the faucet, so when the dedicated faucet is closed, the expansion chamber then immediately creates suction and removes a part of the hot water from the water tank and into the expansion chamber to avoid hot water residue dripping from the faucet. In addition, when the water in the water tank is heated to its boiling point, a part of the hot water will be sucked into the expansion chamber to reduce the pressure in the water tank and prevent the hot water from being ejected out of the faucet due to vapour.

16 Claims, 7 Drawing Sheets

HOT WATER DISPENSER

BACKGROUND OF THE INVENTION

1. Field of the Invention

The present invention relates to a hot water dispensing system, and more particularly, the hot water dispensing system with an expansion chamber disposed within.

2. Description of the Related Art

Integrating a drinking water system on the kitchen counter has been a common practice for a long time. The most common device is a gooseneck faucet connected to a water purification device in the kitchen sink cabinet underneath the kitchen counter. Most water purification devices supply water at room temperature. To supply hot water, there have been cases where the water purification device is redirected to another external water heating system, then onto another gooseneck faucet or a two-in-one gooseneck faucet that can interchange between hot and cold water. The two-in-one gooseneck faucet is connected to both the water purification device and the water heating system so that it can supply both cold and hot water on demand.

The basic structure of the hot water dispensing system mentioned above, such as the U.S. Pat. No. 6,847,782, mainly comprises a Venturi block, an expansion chamber, a water tank, and a heating element for heating-up the water tank. Patents such as CN206434197, CN206944452, and CN207613641 in China, and I384191, I632334, and M499534 in Taiwan, all disclose hot water dispensers with the aforementioned basic structure.

FIG. 8 illustrates the common piping system of this type of hot water dispensers. As shown in the drawing FIG. 8, the prior art comprises a housing 9 within which a water tank 91 is disposed, an expansion chamber 92, and a Venturi block 94. A water outlet 910 of the water tank 91 is connected to an outlet conduit 911, and the outlet conduit 911 extends into a discharge hose 931 of a dedicated faucet 93. A water source 90 (e.g. a water purification device) is connected to an inlet conduit 912, the inlet conduit 912 is then connected to an internal passage (not shown) of the faucet 93, wherein the opening or closing of the internal passage is controlled by a lever 932 of the faucet 93. A Venturi block 94 of the hot water dispenser 9 communicates with an expansion chamber 92. The Venturi block 94 is connected to the internal passage of the faucet 93 by another inlet conduit 913, and is connected to an inlet connector 915 of the water tank 91 by a water inlet 914. When the lever 932 of the faucet 93 is turned to the open position, the cold water from the water source 90 will flow through the inlet conduit 912, the internal passage of the faucet 93, the inlet conduit 913 and flow into the Venturi block 94, and then flow into the water tank 91 through the water inlet 914 and the inlet connector 915. The hot water within the water tank 91 will then be squeezed upwards and flow out through the water outlet 910 of the water tank 91. The hot water will continue to flow through the outlet conduit 911 and then come out of the end of the discharge hose 931 of the dedicated faucet 93.

When the lever 932 of the dedicated faucet 93 is turned to a closed position, the internal passage of the faucet 93 is closed, so that the cold water from the water source 90 cannot flow into the water tank 91 and that the hot water in the water tank 91 stops flowing out of the discharge hose 931 of the faucet 93.

Since the outlet conduit 911 is always in communication with the water tank 91, if there is no expansion chamber 92 in place, the hot water will still drip from the outlet conduit 911 when the faucet 93 is closed. In order to solve the aforementioned problems, the existing hot water dispensers usually have an expansion chamber 92 disposed within (for details of the operation, please refer to previous patents), so when the dedicated faucet 93 is closed, the expansion chamber 92 immediately creates suction and moves a part of the hot water from the water tank 91 into the expansion chamber 92, which makes the hot water that is about to drip from the outlet conduit 911 be immediately sucked back into the water tank 91, and thereby avoiding any potential of hot water residue dripping.

Also, when the temperature of the water in the water tank 91 is very high (e.g. when the water has reached its boiling point through the heating element), since the outlet conduit 911 is always in communication with the water tank 91, the hot water vapour will flow through the outlet conduit 911 and be ejected out of the discharge hose 931 of the faucet 93 without an expansion chamber 92. However, if an expansion chamber 92 is in place, once the water reaches its boiling point within the water tank 91, the expansion chamber 92 will suck some hot water from the water tank 91 to lower the air pressure within the water tank 91, which prevents the water vapour from travelling through the outlet conduit 911 and then being ejected out of the discharge hose 931.

However, the expansion chambers of the existing hot water dispenser is often unable to effectively avoid the situation of water vapour ejection described above, which is why many have started to control the heating element within the tank deliberately by making sure the water tank does not get heated up to its boiling point. However, this does not ensure even or sufficient hot water temperature as desired. On the other hand, there is another solution, which is having an additional water vapour dispensing mechanism to prevent water vapour from being ejected out, that is, either a water vapour dispensing hole (or a water vapour dispensing pipe) is disposed on the faucet, and a water vapour receiving hole (or water vapour receiving tube), and a conduit connecting the water vapour dispensing hole and the water vapour receiving hole. Taiwan Patent No. I632334 adopts the technique mentioned above; however, this technique is known to be costly.

SUMMARY OF THE INVENTION

The present invention disclose a new kind of hot water dispenser comprising a water tank, an expansion chamber disposed above the water tank, a Venturi module that creates the Venturi effect and connected between the water tank and the expansion chamber, and a heating element that heats up the water in the water tank. The expansion chamber comprising a top shell, a bottom shell that connects to the top shell, and a flexible bladder that is disposed between the top shell and the bottom shell.

The top shell comprising a top plate, a top through-hole that pierces the top plate, a top inner periphery that surrounds the top through-hole, and a top outer periphery that surrounds the top plate; the top plate also has a vent hole that pierces through. The bottom shell comprising a bottom plate, a bottom through-hole that pierces the bottom plate and facing the top plate, a bottom inner periphery that surrounds the bottom through-hole, and a bottom outer periphery that surrounds the bottom plate.

The bottom plate also has an extending portion, the extending portion has a channel that communicates with a bottom internal space of the bottom plate. The flexible bladder comprising a plate body, a centre hole that pierces through the plate body and facing the bottom through-hole of the bottom plate, an inner periphery that surrounds the centre hole, and an outer periphery that surrounds the plate body.

The inner periphery of the flexible bladder is tightly squeezed in-between the top inner periphery of the top shell and the bottom inner periphery of the bottom hell, the outer periphery of the flexible bladder is tightly squeezed in-between the top outer periphery of the top shell and the bottom outer periphery of the bottom shell.

The Venturi module is disposed on the extending portion of the bottom shell of the expansion chamber, it also has an upper tube, a lower tube, and a throat portion situated between the upper tube and the lower tube. The throat portion has a narrow longitudinal channel communicating with a lateral channel. The two ends of the narrow longitudinal channel respectively connected to an upper passage of the upper tube and to a lower passage of the lower tube, and the narrow longitudinal channel is smaller in diameter than the upper passage and the lower passage.

The water tank is disposed underneath the expansion chamber and has an upper portion and a lower portion, the upper portion has a water outlet, the lower portion has an inlet connector. The water outlet pierces through the bottom through-hole of the bottom shell of the expansion chamber, the centre hole of the flexible bladder and the top through-hole of the top shell. The inlet connector is used to connect to the lower tube of the Venturi module.

In another aspect, a protruding tube is formed inside the bottom shell, the protruding tube is disposed near the extending portion and has an entrance hole, the entrance hole and the channel of the extending portion communicates, wherein the flexible bladder is capable of blocking and unblocking the entrance hole.

In another aspect, the extending portion of the expansion chamber extends to a position avoiding the water tank so that the Venturi module is positioned longitudinally higher than the water tank and laterally away from the water tank so the Venturi module is not directly above the water tank.

Additionally, the present invention disclose another hot water dispenser, comprising a water tank, a Venturi module connected to the water tank, an expansion chamber connected to the Venturi module, and a heating element for heating the water within the water tank; the expansion chamber comprises a vent hole, an entrance hole, a hollow cavity to communicate with the vent hole and the entrance hole, and a flexible bladder to separate the hollow cavity into two individual cavities, wherein an individual cavity communicates with the outside through the vent hole and the other individual cavity communicates with the Venturi module through the entrance hole; in which, the flexible bladder moves along with the water entering and exiting the water tank and capable of shifting to positions to block and unblock the entrance hole.

In another aspect, the top inner periphery of the top plate sinks from the centre of the top plate so that a top cavity is formed on the top inner periphery.

In another aspect, the bottom inner periphery of the bottom shell is protruding upwards from the centre of the bottom plate so that a bottom cavity is formed under the bottom inner periphery.

In another aspect, the top shell also comprises a protruding ring that protrudes downwards from the top inner periphery and communicates with the top through-hole, the bottom inner periphery of the bottom shell is relative to the position of the protruding ring of the top shell and has a groove that communicates with the bottom through-hole; also the protruding ring of the top shell extends and prop against the groove of the bottom inner periphery of the bottom shell, wherein the water outlet of the water tank pierces through the protruding ring and the groove.

In another aspect, the hot water dispenser further comprises a hollow bolt and a screw nut, the hollow bolt passes through the top through-hole of the top shell, the centre hole of the flexible bladder, and the bottom through-hole of the bottom shell; the screw nut is screwed to the hollow bolt so that the top shell and bottom shell tightly squeezes the inner periphery of the flexible bladder. In which, the water outlet of the water tank also passes through the hollow bolt internally.

In another aspect, the hollow bolt of the hot water dispenser comprises a a head and a body. The head of the hollow bolt is disposed in the top cavity of the top shell. The body of the hollow bolt passes through the top through-hole of the top shell, the centre hole of the flexible bladder, and the bottom through-hole of the bottom shell. The screw nut is disposed in the bottom cavity of the bottom shell and screwed to the body of the hollow bolt, so that the top shell and bottom shell tightly squeezes the inner periphery of the flexible bladder and the water outlet of the water tank also passes through the hollow bolt internally.

In another aspect, the top plate not only comprise the vent hole, but also one or many other vent holes which are evenly distributed on the top plate.

Compared against the prior art, the expansion chamber and its related features of the present invention can effectively avoid dripping of the hot water residue from the faucet and effectively prevent the faucet from ejecting hot water vapour, so that there is no need to manipulate the operations of the heating element within the water tank; also, there is no need to install a water vapour discharge mechanism either, which solves the existing problem of insufficient hot water temperature and high cost.

DETAILED DESCRIPTION OF EMBODIMENTS

Figure 1:
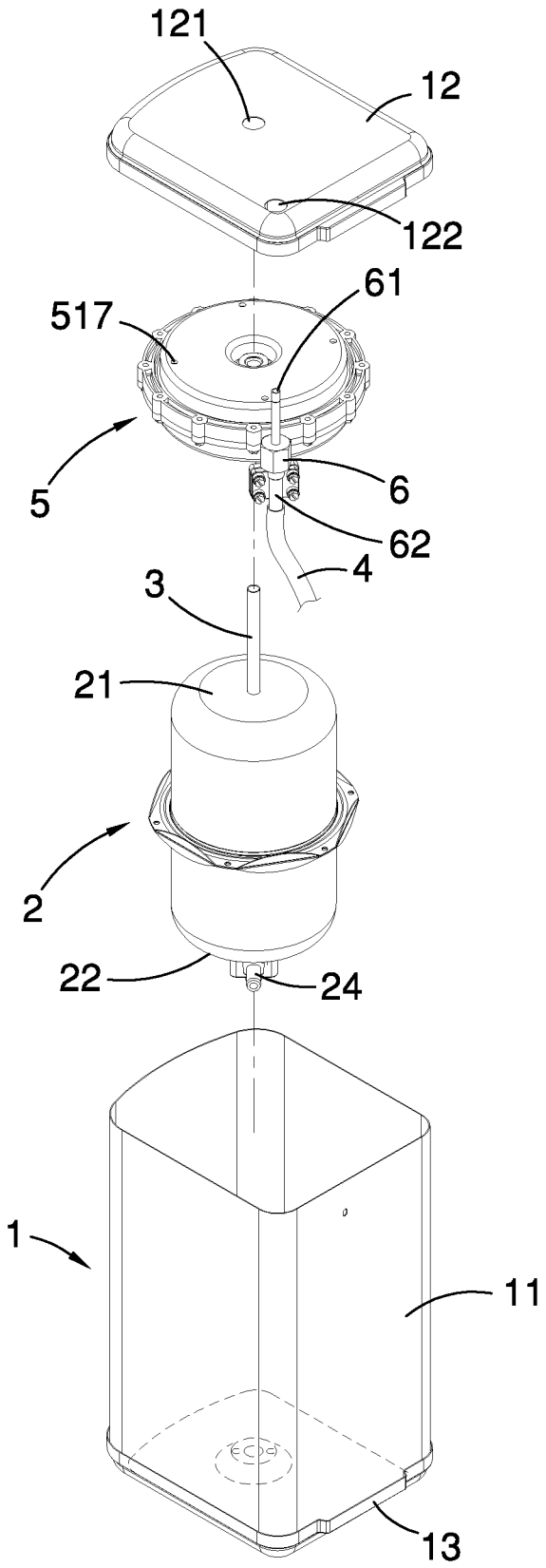
FIG. 1 illustrates an exploded perspective view of a preferred embodiment of the hot water dispenser of the present invention.
Figure 2:
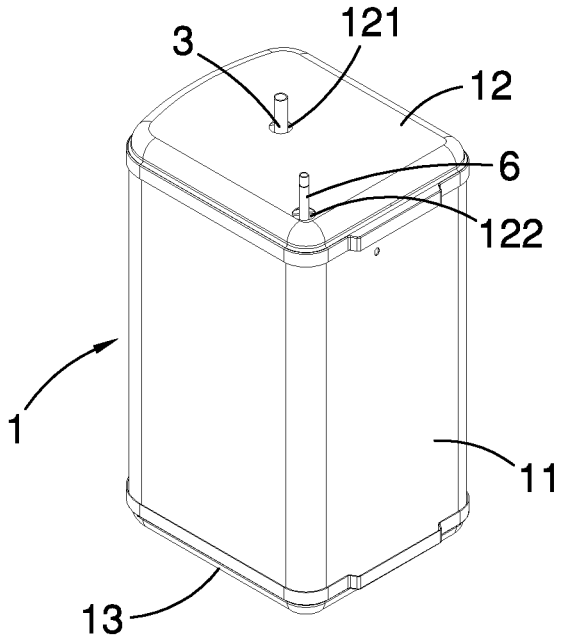
FIG. 2 illustrates a perspective view of the preferred embodiment of the present invention.

Referring to FIGS. 1 and 2 of a preferred embodiment of the present invention comprises a water tank 2, an expansion chamber 5 disposed above the water tank, and a Venturi module 6 connected between the water tank 2 and the expansion chamber 5 that provides a Venturi effect. In which, the expansion chamber 5 and the Venturi module 6 together constitute an expansion device, which can apply to other equipment in addition to the hot water dispenser.

The water tank 2 comprises an upper portion 21 and a lower portion 22. The upper portion 21 has a water outlet 3; the lower portion 22 has an inlet connector 24. Also, a heating element is disposed within the water tank 2 (not shown), the heating element heats the water within the water tank 2. However, the heating element can also be disposed on the outside of the water tank 2. Moreover, there is often a layer of insulation wrapped around the water tank 2 (not shown), e.g. Styrofoam/Polystyrene.

In the preferred embodiment, the water tank 2, expansion chamber 5, and the Venturi module 6 are all disposed within a housing 1. The housing 1 comprises a hollow body 11, a cover 12, and a base 13. The cover 12 has two openings 121 and 122, a small portion of the water outlet 3 and a small portion of the Venturi module 6 respectively pierce through the two openings 121, 122 and extends out of the cover 12.

Figure 3:
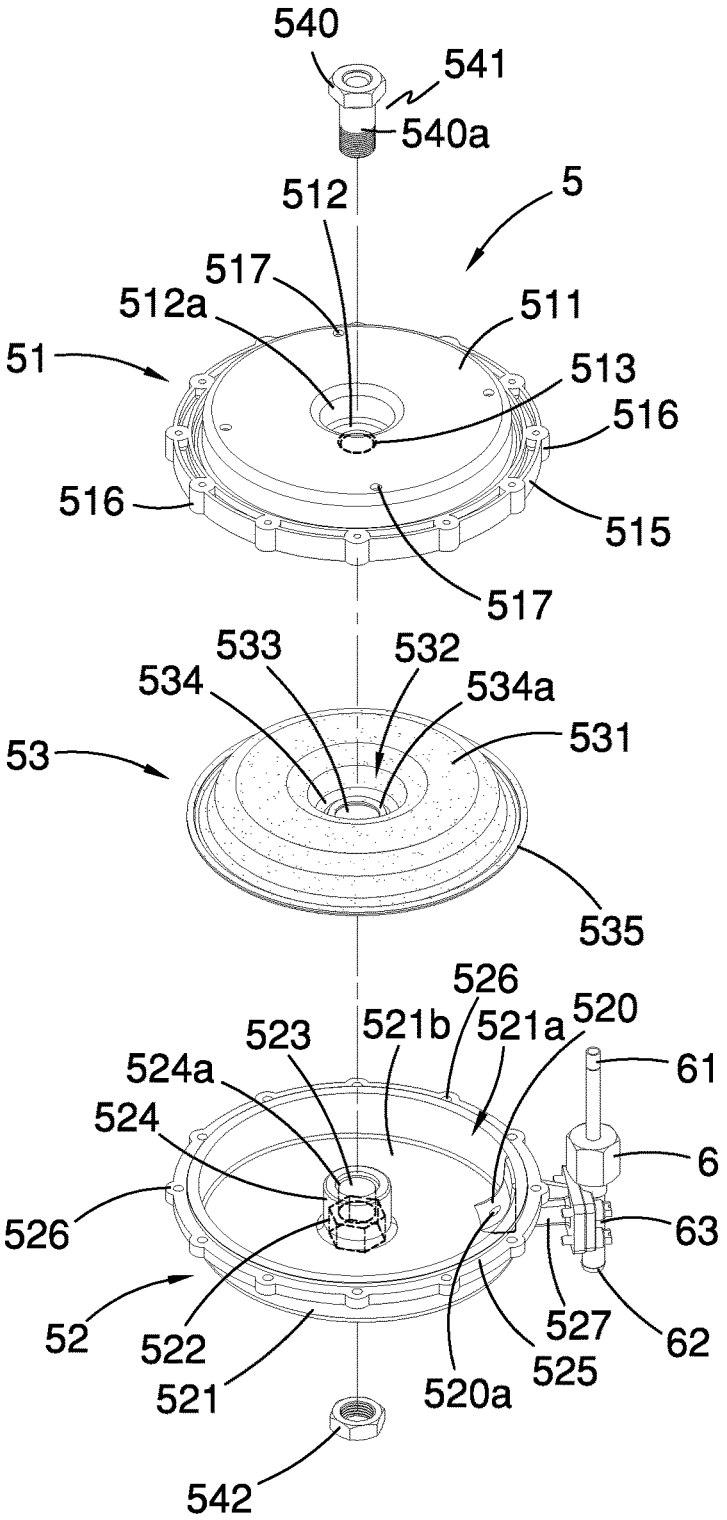
FIG. 3 illustrates an exploded perspective view of the expansion chamber of the preferred embodiment of the present invention.

FIG. 3 illustrates the expansion chamber 5 comprises a top shell 51, a bottom shell 52, and a flexible bladder 53 disposed between the top shell 51 and the bottom shell 52. The top shell 51 and the bottom shell 52 can preferably be made of plastic (e.g. Polyoxymethylene, POM) but not limited to. The top shell 51, the bottom shell 52 and the flexible bladder 52 can be of a variety of shapes, whether its polygon, round or oval; preferably round but not limited to. Additionally, the flexible bladder 53 can be made of either silicone or rubber but not limited to.

Figure 5:
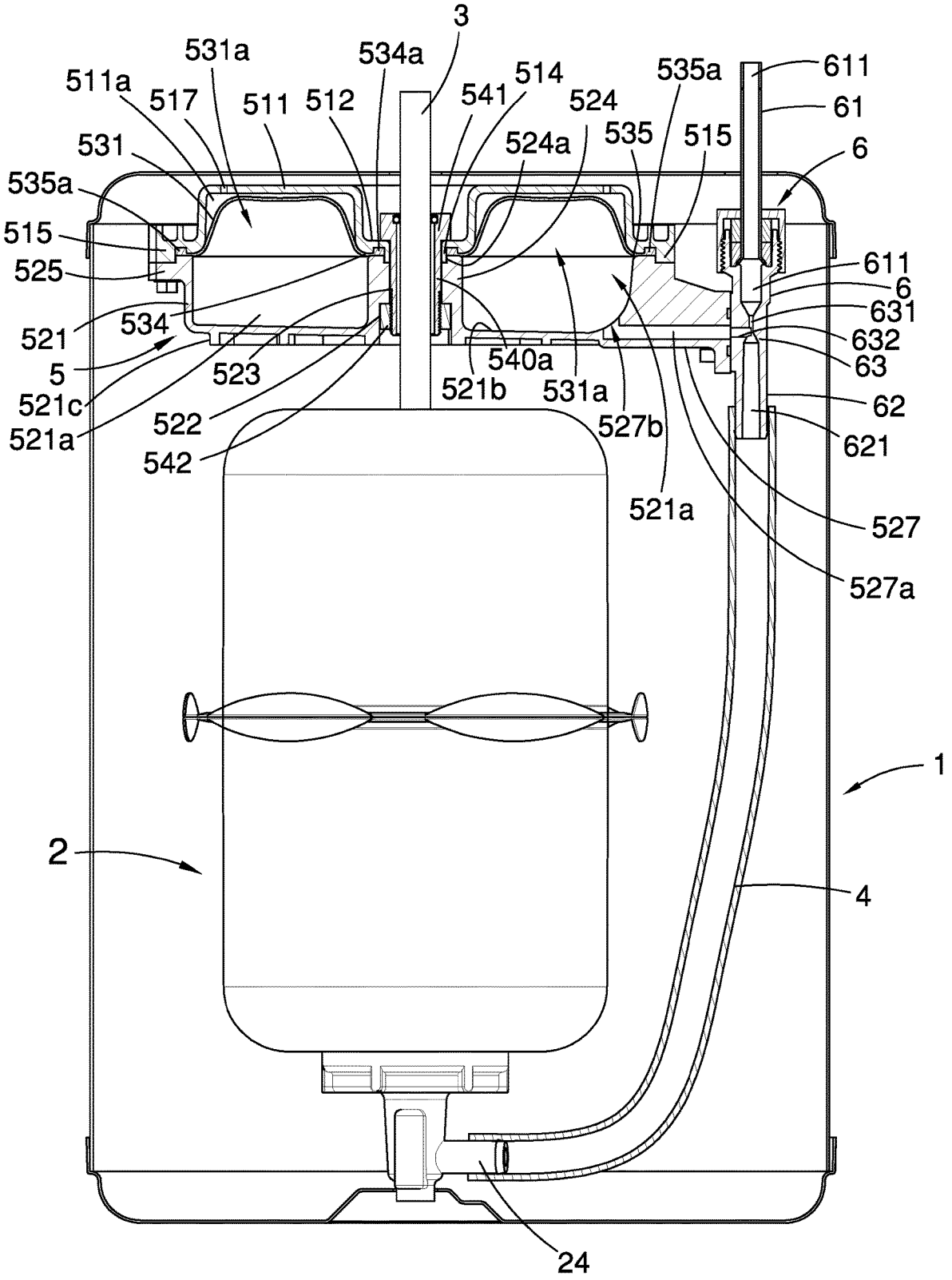
FIGS. 5 and 6 illustrates a cross-sectional view of the preferred embodiment of the present invention under different usage state.

Referring to FIGS. 3 and 5, the top shell 51 comprises a top plate 511, a top through-hole 513 that pierces through the top plate 511, a top inner periphery 512 that surrounds the top through-hole 513, and a top outer periphery 515 that surrounds the top plate 511; the top plate 511 also has at least one vent hole 517 that pierces through, preferably many vent holes 517 that evenly distributes on the top plate 511 (e.g. four vent holes). In the preferred embodiment, the top inner periphery 512 sinks from the centre of the top plate 511, so that a top cavity 512*a* is formed on the top inner periphery 512. Additionally, the top shell 51 also has a protruding ring 514 that protrudes downwards from the top inner periphery 512 and communicates with the top through-hole 513, and a plurality of spacer rings are arranged on a top joint portion 516 of the top outer periphery 515.

The bottom shell 52 comprises a bottom plate 521, a bottom through-hole 523 that pierces through the bottom plate 521 and facing the top through-hole 513 of the top plate 511, a bottom inner periphery 524 that surrounds the bottom through-hole 523, and a bottom outer periphery 525 that surrounds the bottom plate 521; the bottom plate 521 also has an extending portion 527, the extending portion 527 has a channel 527*a* that communicates with a bottom internal space 521*a* of the bottom plate 521. In the preferred embodiment, the bottom inner periphery 524 is protruding upwards from the centre of the bottom plate 521, so that a bottom cavity 522 is formed under the bottom inner periphery 524. In which, the position of the bottom inner periphery 524 relative to the protruding ring 514 of the top shell 51 also has a groove 524*a* that communicates with the bottom through-hole 523. Additionally, a plurality of spacer rings are arranged on a bottom joint portion 526 of the bottom outer periphery 525. In which, each bottom joint portion 526 of the bottom shell 52 uses a joint assembly (not shown) to combine together with the top joint portion 516 of the top shell 51. In which, the joint assembly is commonly a bolt and a nut (not shown) that can be screwed together.

The flexible bladder 53 comprises a plate body 531, a centre hole 533 that pierces through the plate body 531 and facing the bottom through-hole 523 of the bottom plate 521, an inner periphery 534 that surrounds the centre hole 533, an outer periphery 535 that surrounds the plate body 531. In the preferred embodiment, the inner periphery 534 sinks from the centre of the plate body 531, so that a sinking portion 532 is formed on the inner periphery 534. In which, the plate body 531 is preferably disposed within a top internal space 511*a* of the top shell 51, and a top surface of the plate body 531 is leaning to a corresponding wall surface inside the top plate 511. In addition, the inner periphery 534 of the flexible bladder 53 has a restricting portion 534*a* that protrudes upwards, and the outer periphery 535 also has a restricting portion 535*a* that protrudes upwards.

When the top shell 51 is combined with the bottom shell 52, the inner periphery 534 of the flexible bladder 53 will be tightly squeezed between the top inner periphery 512 of the top shell 51 and the bottom inner periphery 524 of the bottom shell 52, the outer periphery 535 of the flexible bladder 53 will be tightly squeezed between the top outer periphery 511 of the top shell 51 and the bottom outer periphery 525 of the bottom shell 52, the bottom internal space 521*a* of the bottom shell 52 communicates with an interior 531*a* of the flexible bladder 53 and forming a variable volume cavity. In the preferred embodiment, the protruding ring 514 of the top shell 51 also extends into and prod against the groove 524*a* of the bottom shell 52, and in this case, the water outlet 3 of the water tank 2 will of course pierced through the groove 524*a* and the protruding ring 514.

In the preferred embodiment, the present invention also comprises a hollow bolt 541 and a screw nut 542, as FIG. 5 illustrated, a head 540 of the hollow bolt 541 is disposed in the top cavity 512*a* of the top shell 51, a body 540*a* of the hollow bolt 541 going from up to down passes through the top through-hole 513 and the protruding ring 514 of the top shell 51, the centre hole 533 of the flexible bladder 53, the groove 524*a* and the bottom through-hole 523 of the bottom shell 52. The screw nut 543 is disposed in the bottom cavity 522 of the bottom shell 52 and screwed to the body 540*a* of the hollow bolt 541 so that the top shell 51 and the bottom shell 52 tightly squeezes the inner periphery 534 of the flexible bladder 53. The water outlet 3 of the water tank 2 also passes through the hollow bolt 541 internally.

Figure 4:
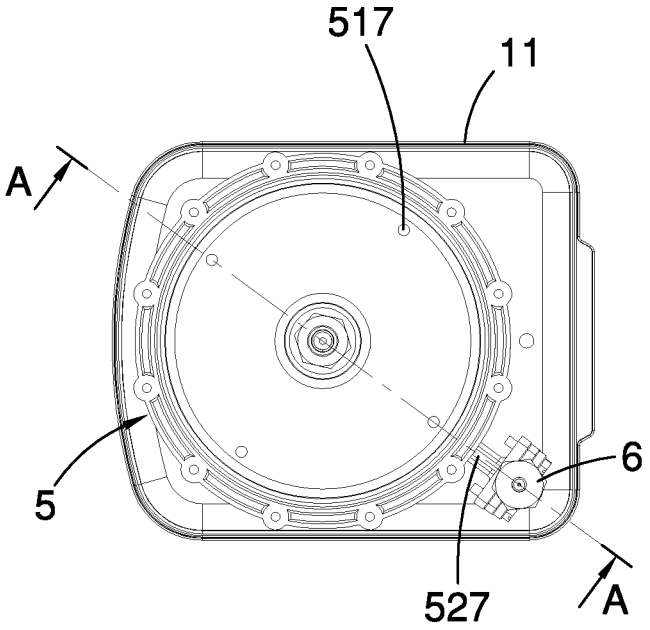
FIG. 4 illustrates a top view of the preferred embodiment of the present invention (the cover 12 is omitted)

Referring to FIGS. 4 and 5, the Venturi module 6 is disposed on the extending portion 527 of the bottom shell of the expansion chamber 5. In the preferred embodiment, the extending portion 527 extends to an extension position away from the water tank 2 so that the position of the Venturi module 6 in the longitudinal direction is higher than the water tank 2, and the position in the lateral direction is away from the water tank 2 as well and therefore not directly above the water tank 2. Additionally, the Venturi module 6 comprises an upper tube 61, a lower tube 62, and a throat portion 63 situated between the upper tube 61 and the lower tube 62. The lower tube 62 is connected to the inlet connector 24 of the water tank 2 by a water inlet 4. The throat portion 63 has a narrow longitudinal channel 631 and a lateral channel 632 that communicates, the lateral channel 632 communicates with the channel 527*a* of the extending portion 527, one end of the narrow longitudinal channel 631 connects to an upper passage 611 of the upper tube 61, the other end of the narrow longitudinal channel 631 connects to a lower passage 621 of the lower tube 62. In which, the narrow longitudinal channel 631 is smaller in diameter than the upper passage 611 and the lower passage 621, and the lateral channel 632 is smaller in diameter than the channel 527*a*, but larger than the narrow longitudinal channel 631.

Preferably, a bottom surface 521*b* located in the bottom plate 521 is inclined towards the extending portion 527, and a base portion of a base 521*c* located outside the bottom plate 521 is flat.

In this embodiment, referring to FIGS. 1 and 5, the bottom shell 52 has a protruding tube 520 within, the protruding tube 520 is disposed near the extending portion 527 and has an entrance hole 520*a*, the entrance hole 520*a* and the channel 527*a* of the extending portion 527 communicates. As a result, the entrance hole 520*a* is an equivalent of an entrance and exit hole inside the bottom shell 52 of the lateral channel 632 of the Venturi module 6.

Figure 6:
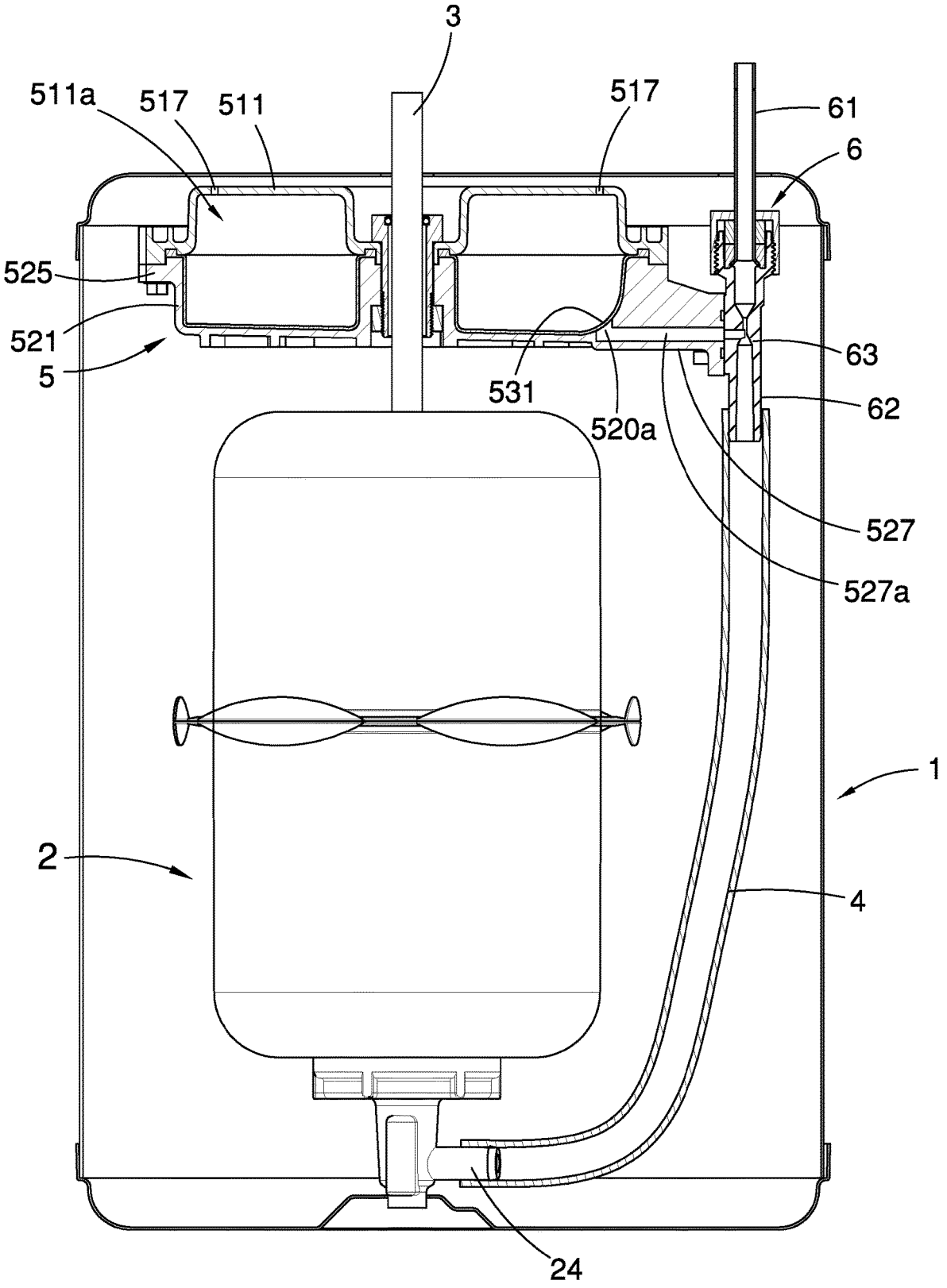
Figure 7:
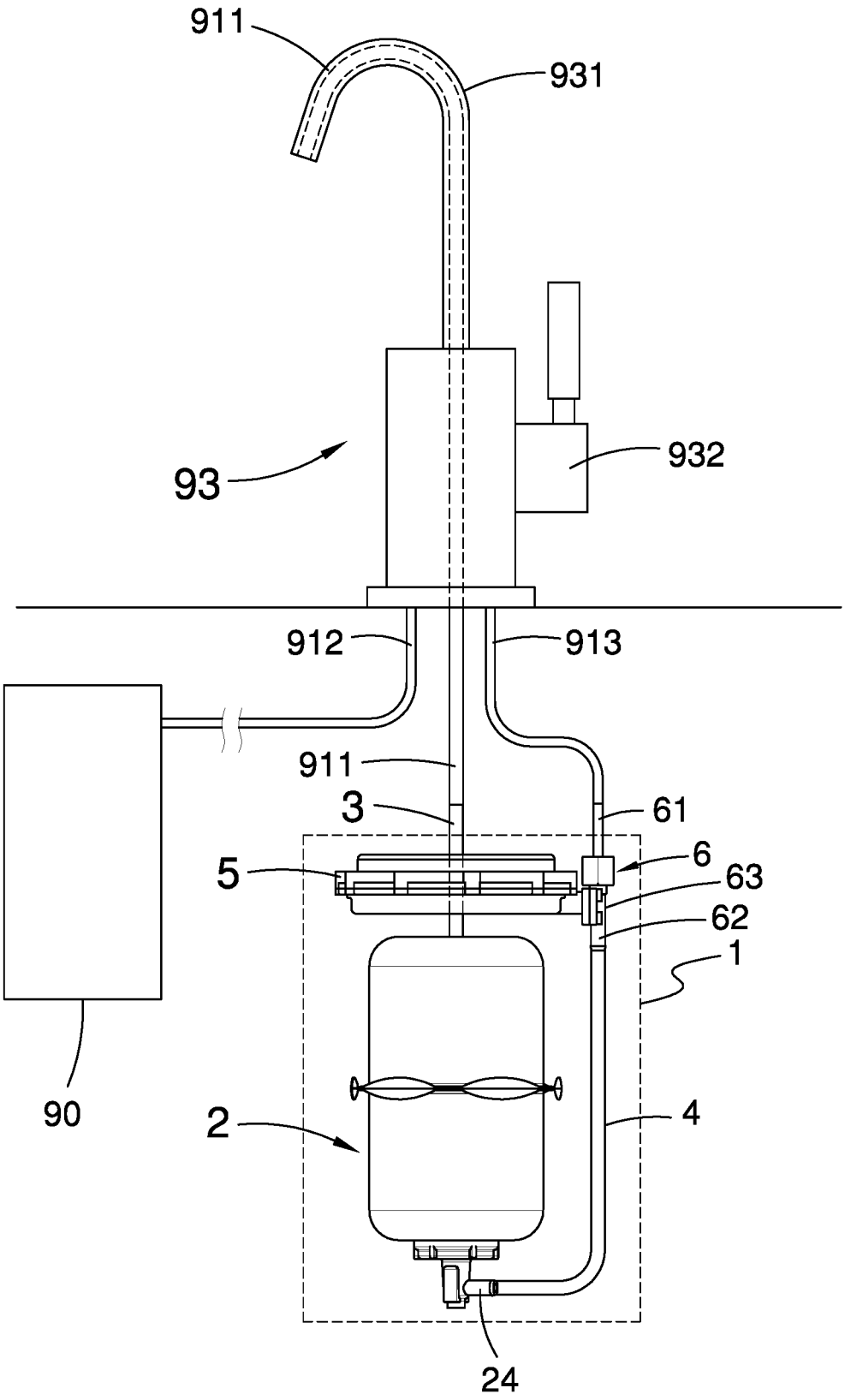
FIG. 7 illustrates a schematic diagram of a piping system of the hot water dispenser of the present invention.
Figure 8:
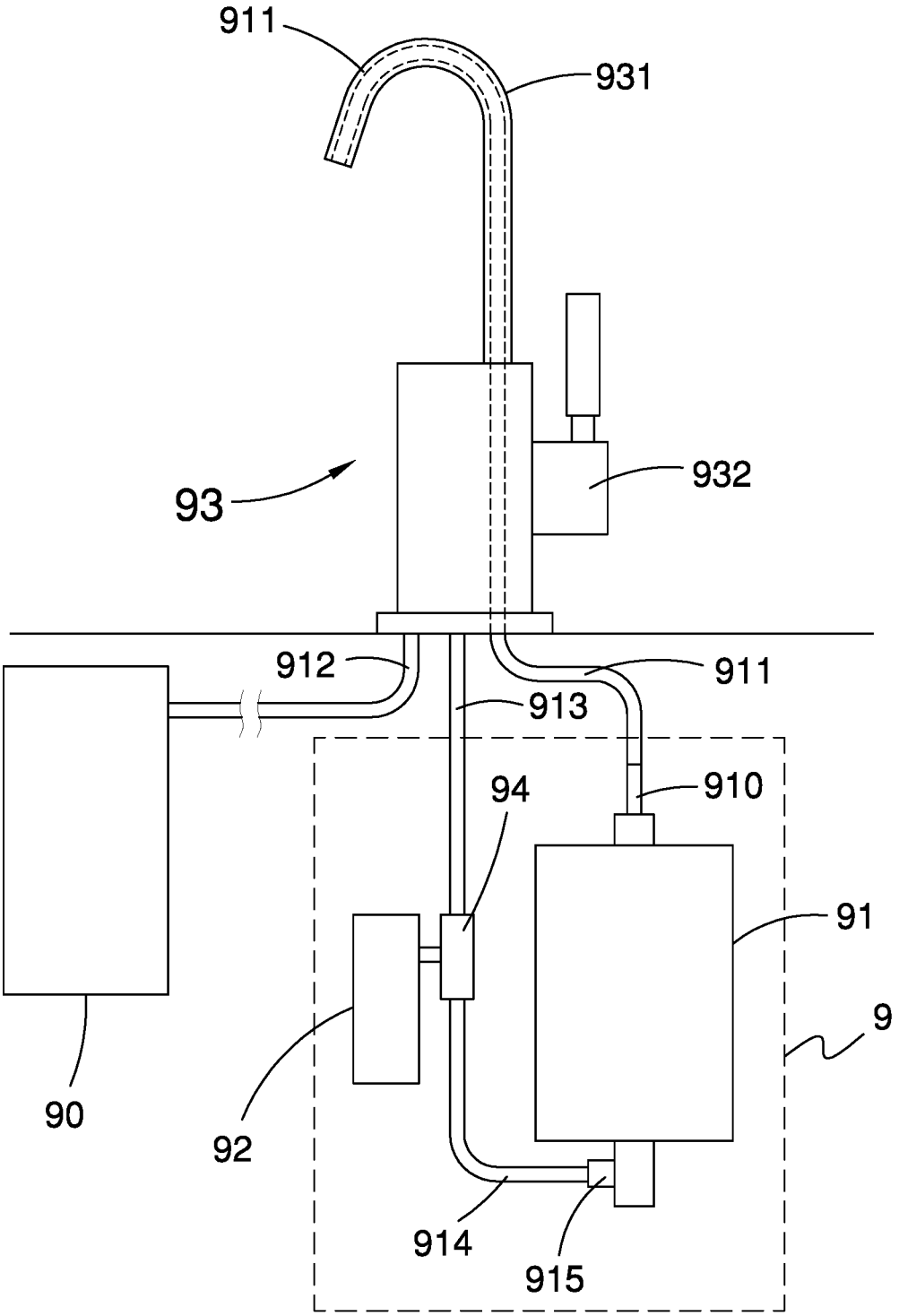
FIG. 8 illustrates a schematic diagram of a piping system of the prior arts.

In this embodiment, referring to FIGS. 5 and 7, the outlet conduit 911 in the discharge hose 931 of the faucet 93 is connected to the water outlet 3 of the water tank 2 of the present invention, and the inlet conduit 913 of the faucet 93 is connected to the upper tube 61 of the Venturi module 6 of the present invention. In the beginning, the water tank 2 is empty, when the faucet 93 is turned on through the lever 932 on a ON position, the above mentioned water source 90 will travel through the inlet conduit 912, the internal passage of the faucet 93 and the inlet conduit 913, then enter the upper passage 611 of the Venturi module 6, then flow past then narrow longitudinal channel 631 of the throat portion 63, lower passage 621 of the lower tube 62, after connecting the water inlet 4 and the inlet connector, the water then flow into the water tank 2 of the present invention. During the process of filling up the water tank 2 with cold water, the cold water that flows through the Venturi module 6 will cause a Venturi effect so that the flexible bladder 53 of the FIG. 5 moves downwards. Once the water tank 2 is filled up with cold water, the flexible bladder 53 will be shifted within bottom shell 52 and in a state as shown in FIG. 6. It is important to understand that as of this moment, the entrance hole 520*a* of the bottom shell 52 is blocked and sealed by the plate body 531 of the flexible bladder 53 and the space between the bottom shell 52 and the flexible bladder 53 has been minimised to none. From then on, if the lever 932 of the faucet 93 stays in the open position, the cold water that is continually flowing into the water tank 2 will causes the hot water originally in the water tank 2 to be squeezed upwards and flow out from the water outlet 3, then, the water flow out from the discharge hose 931 of the faucet 93 along the outlet conduit 911. When the lever 932 of the faucet 93 is closed, the water from the water source 90 will no longer flow into the water tank 2 of the present invention, so that the outlet conduit 911 of the discharge hose 931 of the faucet 93 stops outputting water. In which, when the faucet 93 is turned on, the flexible bladder 53 of the expansion chamber 5 will immediately start move downwards because of the cold water no longer flows through the Venturi module 6, and the moment when the faucet 93 is closed, because the water no longer flow through the Venturi module 6, the flexible bladder 53 the moves upwards in an instant, which causes a section effect, so that a part of the water in the water tank 2 flows into a cavity inbetween the bottom shell 52 and the flexible bladder 53 along the water inlet 4, the lower passage 621 of the lower tube 62, the narrow longitudinal channel 631 and the lateral channel 632 of the throat portion 63, and the channel 527*a*. As a result, the hot water in the outlet conduit 911 is instantly sucked back into the water tank 2 to avoid the above-mentioned hot water residue dripping from the outlet conduit 911.

Normally, once the cold water fills up the water tank 2, the water tank 2 will be heated to hot water. The user only needs to turn the lever 932 of the faucet 93 to the open position, and the cold water from the water source 90 will flow into the hot water tank 2 through the Venturi module 6, and squeeze the hot water in the hot water tank 2 upwards. The hot water flows out from the outlet conduit 911 for drinking. In the process, as described above, flexible bladder 53 will move downward. Once the user turns the lever 932 of the faucet 93 to the closed position, as described above, the flexible bladder 53 will move upward, so that the hot water in the outlet conduit 911 is sucked back into the hot water tank 2 to avoid hot water residue dripping from the outlet conduit 911.

Furthermore, when the water in the water tank 2 reaches its boiling point, a part of the water in the water tank 2 will be immediately squeezed into the expansion chamber 5 (or sucked in), thereby reducing the pressure within the water tank 2 to prevent the water vapour from moving along the outlet conduit 911 then ejecting out of the discharge hose 931 of the faucet 93.

In addition, it can be seen from the above description of the present invention that the expansion chamber 5 comprises the above-mentioned vent hole 517, the above-mentioned entrance hole 520*a*, a hollow cavity communicating with the vent hole 517 and the entrance hole 520*a*, and the hollow cavity is divided into two independent cavities by a flexible bladder (for example, the aforementioned flexible bladder 53). One of the independent cavities (for example, the top internal space 511*a* of the top shell 51) communicates with the outside through the vent hole 517, and the other independent cavity (for example, the top cavity 512*a* of the bottom shell 52) is connected to the above-mentioned Venturi module 6 via the opening 520*a*. In which, the flexible bladder can correspondingly move with the water in or out of the water tank 2, and can move to a position where the entrance hole 520*a* blocks or another position that unblocks the entrance hole 520*a*. Preferably, the expansion chamber 5 and the flexible bladder are both disc-shaped, as shown in the above-mentioned embodiment, but not limited to this.

Compared with the prior art, the hot water dispenser of the present invention can effectively avoid the hot water residue dripping and the hot water vapour from the expansion chamber 5 above and will not need to deliberately manipulate the operations of the heating element, and there is no need to set up an additional water vapour discharge mechanism, which solves the existing problems of insufficient hot water temperature and high cost.

What is claimed is:

1. A hot water dispenser, comprising:

an expansion chamber comprising a top shell, a bottom shell correspondingly connected to the top shell, and a flexible bladder disposed between the top shell and the bottom shell; the top shell comprising a top plate, a top through-hole penetrating through the top plate, a top inner periphery surrounding the top through-hole, and a top outer periphery surrounding the top plate, wherein the top plate has a vent hole penetrating through; the bottom shell comprising a bottom plate, a bottom through-hole penetrating through the bottom plate and facing the top through-hole of the top plate, a bottom inner periphery surrounding the bottom through-hole, and a bottom outer periphery surrounding the bottom plate, wherein the bottom plate also has an extending portion, the extending portion has a channel communicating with an internal space of the bottom plate; the flexible bladder comprising a plate body, a centre hole penetrating the plate body and facing the bottom through-hole of the bottom plate, an inner periphery surrounding the centre hole, and an outer periphery surrounding the plate body, wherein the inner periphery of the flexible bladder is tightly squeezed in between the top inner periphery of the top shell and the bottom inner periphery of the bottom shell, the outer periphery of the flexible bladder is tightly squeezed in between the top outer periphery of the top shell and the bottom outer periphery of the bottom shell;

a Venturi module disposed on the extending portion of the bottom shell of the expansion chamber comprising an upper tube, a lower tube, and a throat portion situated between the upper tube and the lower tube, wherein the throat portion has a narrow longitudinal channel communicating with a lateral channel, the two ends of the narrow longitudinal channel respectively connected to an upper passage of the upper tube and to a lower passage of the lower tube, and the narrow longitudinal channel is smaller in diameter than the upper passage and the lower passage;

a water tank disposed below the expansion chamber and having an upper portion and a lower portion, wherein the upper portion has a water outlet, the lower portion has an inlet connector, the water outlet penetrating through the bottom through-hole of the bottom shell of the expansion chamber, the centre hole of the flexible bladder and the top through-hole of the top shell, the inlet connector for connecting with the lower tube of the Venturi module; and a heating element for heating the water within the water tank.

2. The dispenser recited in claim 1, wherein the extending portion of the expansion chamber extends to a position avoiding the water tank so that the Venturi module is positioned longitudinally higher than the water tank and laterally away from the water tank so the Venturi module is not directly above the water tank.

3. The dispenser recited in claim 1 wherein the top inner periphery of the top shell sinks from the centre of the top plate, so that a top cavity is formed on the top inner periphery.

4. The dispenser recited in claim 1 wherein the bottom inner periphery of the bottom shell protrudes upwards from the centre of the bottom plate, so that a bottom cavity is formed under the bottom inner periphery.

5. The dispenser as recited in claim 1 wherein the top inner periphery of the top shell sinks from the centre of the top plate, so that a top cavity is formed on the top inner periphery; the inner periphery of the flexible bladder sinks from the centre of the plate body, so that a sinking portion is formed on the inner periphery, and the sinking portion is for receiving the top inner periphery of the top shell; the bottom inner periphery of the bottom shell protrudes upwards from the centre of the bottom plate, so that a bottom cavity is formed under the bottom inner periphery.

6. The dispenser as recited in claim 5 wherein the top shell further comprising a protruding ring protruding downwards from the top inner periphery and communicating with the top through-hole, a groove communicating with the bottom through-hole is situated at a position on the bottom inner periphery of the bottom shell and corresponding to the position of the protruding ring of the top shell, the protruding ring of the top shell also extends and props against the groove of the bottom inner periphery of the bottom shell, wherein, the water outlet of the water tank penetrates through the protruding ring and the groove.

7. The dispenser recited in claim 5 comprises a hollow bolt and a screw nut, a head of the hollow bolt is disposed in the top cavity of the top shell; a body of the hollow bolt passes through the top through-hole of the top shell, the centre hole of the flexible bladder, and the bottom through-hole of the bottom shell, the screw nut is disposed in the bottom cavity of the bottom shell and screwed to the body of the hollow bolt, wherein, the top shell and bottom shell tightly squeezes the inner periphery of the flexible bladder and the water outlet of the water tank also passes through the hollow bolt internally.

8. The dispenser as recited in claim 1 further comprises a hollow bolt and a screw nut, wherein the hollow bolt passes through the top through-hole of the top shell, the centre hole of the flexible bladder, and the bottom through-hole of the bottom shell; the screw nut is screwed to the hollow bolt so that the top shell and bottom shell tightly squeezes the inner periphery of the flexible bladder and the water outlet of the water tank also passes through the hollow bolt internally.

9. The dispenser recited in claim 1 wherein the top plate not only comprise the vent hole, but also one or many other vent holes which are evenly distributed on the top plate.

10. The dispenser recited in claim 1 wherein a protruding tube is formed inside the bottom shell, the protruding tube is disposed near the extending portion and has an entrance hole, the entrance hole and the channel of the extending portion communicates, in which, the flexible bladder is capable of blocking and unblocking the entrance hole.

11. A hot water dispenser, comprising a water tank, a Venturi module connected to the water tank, an expansion chamber connected to the Venturi module, and a heating element for heating the water within the water tank; the expansion chamber comprises a vent hole, an entrance hole, a hollow cavity to communicate with the vent hole and the entrance hole, and a flexible bladder to separate the hollow cavity into two individual cavities, wherein an individual cavity communicates with the outside through the vent hole and the other individual cavity communicates with the Venturi module through the entrance hole; in which, the flexible bladder moves along with the water entering and exiting the water tank and capable of shifting to positions to block and unblock the entrance hole.

12. The dispenser recited in claim 11 wherein the expansion chamber comprise a top shell, a bottom shell connected to the top shell; the top shell comprising a top plate, a top through-hole penetrating through the top plate, a top inner periphery surrounding the top through-hole, and a top outer periphery surrounding the top plate, the vent hole is formed on the top plate; the bottom shell comprising a bottom plate, a bottom through-hole penetrating through the bottom plate and facing the top through-hole of the top plate, a bottom inner periphery surrounding the bottom through-hole, and a bottom outer periphery surrounding the bottom plate, the entrance hole is formed on the bottom plate; the flexible bladder comprising a plate body, a centre hole penetrating the plate body and facing the bottom through-hole of the bottom plate, an inner periphery surrounding the centre hole, and an outer periphery surrounding the plate body, wherein the inner periphery of the flexible bladder is tightly squeezed in between the top inner periphery of the top shell and the bottom inner periphery of the bottom shell, the outer periphery of the flexible bladder is tightly squeezed in between the top outer periphery of the top shell and the bottom outer periphery of the bottom shell, as to that the hollow cavity is separated into two individual cavities.

13. The dispenser recited in claim 12 wherein the top inner periphery of the top shell sinks from the centre of the top plate, so that a top cavity is formed on the top inner periphery; the inner periphery of the flexible bladder sinks from the centre of the plate body, so that a sinking portion is formed on the inner periphery, and the sinking portion is for receiving the top inner periphery of the top shell; bottom inner periphery of the bottom shell protrudes upwards from the centre of the bottom plate, so that a bottom cavity is formed under the bottom inner periphery.

14. The dispenser recited in claim 13 comprises a hollow bolt and a screw nut, a head of the hollow bolt is disposed in the top cavity of the top shell; a body of the hollow bolt passes through the top through-hole of the top shell, the centre hole of the flexible bladder, and the bottom through-hole of the bottom shell, the screw nut is disposed in the bottom cavity of the bottom shell and screwed to the body of the hollow bolt, wherein, the top shell and bottom shell tightly squeezes the inner periphery of the flexible bladder and a water outlet of the water tank also passes through the hollow bolt internally.

15. The dispenser recited in claim 12 comprises a hollow bolt and a screw nut, wherein the hollow bolt passes through the top through-hole of the top shell, the centre hole of the flexible bladder, and the bottom through-hole of the bottom shell; the screw nut is screwed to the hollow bolt so that the top shell and bottom shell tightly squeezes the inner periphery of the flexible bladder and the water outlet of the water tank also passes through the hollow bolt internally.

16. The dispenser as recited in claim 12 wherein the top plate not only comprise the vent hole, but also one or many other vent holes which are evenly distributed on the top plate.

* * * * *